US005832942A

United States Patent [19]

Gutberlet

[11] Patent Number: 5,832,942

[45] Date of Patent: Nov. 10, 1998

[54] COSMETIC PENCIL

[75] Inventor: Horst Gutberlet, Altdorf, Germany

[73] Assignee: h & m gutberlet GmbH industrievertretungen c.d.h., Nürnberg, Germany

[21] Appl. No.: 854,268

[22] Filed: May 9, 1997

[30] Foreign Application Priority Data

May 18, 1996 [DE] Germany ..... 296 08 964 U

[51] Int. Cl.[6] ..... A45D 40/26

[52] U.S. Cl. ..... 132/317; 401/81; 401/123; 401/126

[58] Field of Search ..... 132/317, 318, 132/320, 218; 401/29, 81, 123, 126, 130

[56] References Cited

U.S. PATENT DOCUMENTS

| | | | |
|---|---|---|---|
| 1,534,873 | 4/1925 | Roystone | 401/130 |
| 2,219,000 | 10/1940 | Williams | 132/318 |
| 3,613,697 | 10/1971 | Andrews | 132/317 |
| 4,626,119 | 12/1986 | Ladd, Jr. | 401/123 |
| 4,752,147 | 6/1988 | Persi | 401/123 |
| 4,828,419 | 5/1989 | Porter et al. | 401/123 |
| 4,880,326 | 11/1989 | Spivey et al. | 401/123 |
| 5,040,914 | 8/1991 | Fitjer | 401/81 |
| 5,097,853 | 3/1992 | Nehashi . | |

FOREIGN PATENT DOCUMENTS

| | | | |
|---|---|---|---|
| 38 22 456 | 4/1990 | Germany . | |
| 3923731 | 1/1991 | Germany | 401/81 |
| 9207228 | 10/1992 | Germany | 401/126 |
| 9418823 | 3/1995 | Germany | 132/317 |

*Primary Examiner*—Todd E. Manahan
*Assistant Examiner*—Eduardo C. Robert
*Attorney, Agent, or Firm*—Browdy and Neimark

[57] ABSTRACT

A cosmetic pencil having at least one applicator to which a detachable reservoir for a cosmetic substance is engaged. The applicator and the reservoir are spring-loaded and rotatable relative to each other. An axially displaceable cover having apertures is provided over the applicator so that a comparatively soft cosmetic substance can be used in the reservoir. The cover is located between the surface of the cosmetic substance and the applicator.

6 Claims, 1 Drawing Sheet

COSMETIC PENCIL

BACKGROUND OF THE INVENTION

1. Field of the Invention

The invention relates to a cosmetic pencil comprising at least one applicator to which a detachable reservoir for a cosmetic substance is allocated, the applicator and the reservoir being spring-loaded and rotatable relative to each other.

2. Background Art

A cosmetic pencil of the generic type is known for instance from DE-U-94 18 823. At each of its ends, this prior art cosmetic pencil possesses an applicator spring-loaded axially outwardly, two reservoirs containing a cosmetic substance being screwed on the ends. Other cosmetic pencils of the type under regard are structured in such a way that the reservoirs comprise a longitudinally displaceable cup filled with a cosmetic substance, a helical spring being disposed between the bottom of the cup and the bottom of the reservoir and providing for the production of axial pressure for the applicator closely to contact the surface of the cosmetic substance.

Cosmetic pencils of the generic type have given an excellent account of themselves in practice. However, they may give rise to problems when a comparatively soft cosmetic substance is used. There is the risk that owing to the axial load of the spring, the applicator is forced deep into the cosmetic substance, defined scraping on the surface not being ensured any longer.

SUMMARY OF THE INVENTION

It is the object of the invention to improve a cosmetic pencil of the generic type such that even a comparatively soft cosmetic substance can be used.

According to the invention, this object is attained by the reservoir, between the surface of the cosmetic substance and the applicator, comprising an axially displaceable cover provided with apertures. On the one hand, this cover serves to take up and uniformly distribute the pressure of the applicator acting against it; on the other hand the apertures allow the cosmetic substance to pass from the reservoir to the surface of the applicator.

In keeping with another embodiment of the invention, it is provided that the apertures are embodied as slits, preferably that the slits extend from the center radially outward. This arrangement helps put into practice that any rotation will be accompanied with a scraping and stripping function.

By advantage, the shape of the cover is suited to the shape of the applicator for the applicator and the cover to have maximum surface contact.

By alternative to the provision of slits, the apertures may form a pattern of holes, it being conceivable to have the cover designed as a grid.

So as to achieve that the cosmetic substance is used up completely without any residue sticking on the walls of the reservoir, provision can advantageously be made for the cover to have lateral lips joined on in such a way that upon displacement of the cover, the cosmetic substance is moved toward the middle.

Finally, an internally threaded ring can be fixed in the vicinity of the outer edge of the reservoir, this ring delimiting the displacement of the cover outward in the axial direction.

Details of the invention will become apparent from the ensuing description of a preferred embodiment, taken in conjunction with the drawing.

DESCRIPTION OF THE PREFERRED EMBODIMENT

Figure 1:
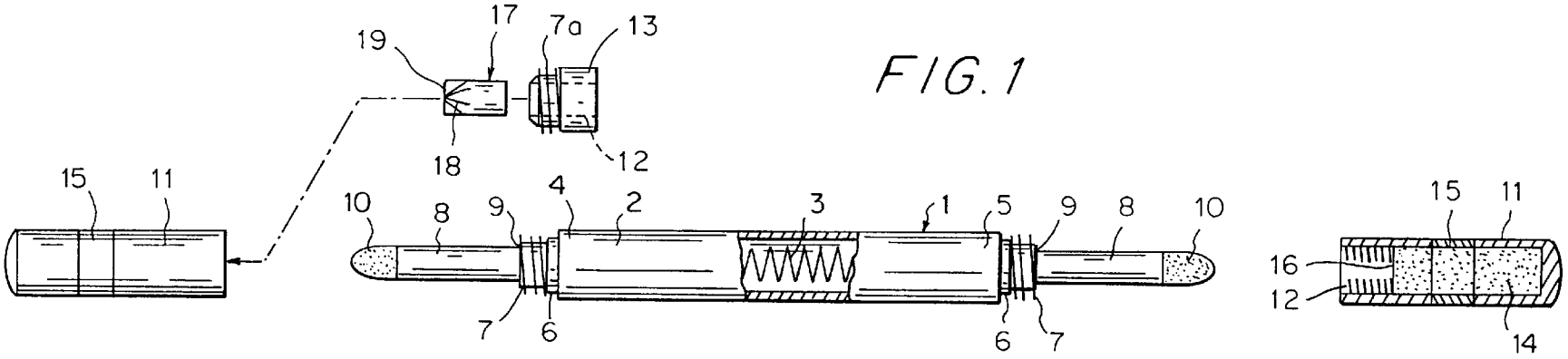
FIG. 1 is a lateral view—partially broken away—of a cosmetic pencil according to the invention.
Figure 3:
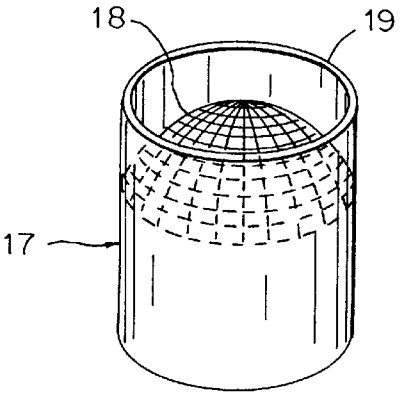
FIG. 3 is another embodiment of the cover according to FIG. 2.

A cosmetic pencil 1 seen in FIG. 1 comprises a cylindrical basic body 2, in the interior of which a helical spring 3 is disposed. The two ends 4, 5 of the basic body 2 are closed by end sleeves 6 pushed in and fastened by means of ultrasonic welding and having an external thread section 7.

The helical spring 3 presses against the inner ends of applicator pipes 8, not seen in the drawing, a stop being provided on the inside of each applicator pipe 8, preventing the applicator pipes 8 from being extended out of the frontal openings 9 by the action of the helical spring 3.

The drawing does not show four projections and four groove-type guides which ensure that the applicator pipes 8 are guided axially displaceably, but non-rotatably in the basic body 2.

An applicator 10 of synthetic latex is disposed at the free extreme end of each applicator pipe 8. By means of an internal thread 12, screw caps 11 can be screwed on the two external thread sections 7.

A cosmetic substance is directly poured into each screw cap 11 so that the screw cap 11 may be used as a separate reservoir for the cosmetic 14 in addition to serving as a cover for the applicator 10. To this end, a screw-type ring 13 is provided as further explained below, having a threaded section 7*a* which corresponds to the threaded section 7 and the basic body 2. Correspondingly, the user has the possibility to select a screw cap containing a cosmetic of choice and may then screw the corresponding cap 11 on the basic body 2 which, if required, may previously have had empty screw caps.

Each screw cap 11 has a transparent section 15, it being possible to see from outside whether there is still some cosmetic substance 14 left in the respective screw cap 11 and which is the color of this cosmetic substance 14. The drawing does not show projections on the bottom of each screw cap 11 which provide for the substance 14 to be fixed non-rotatably in the screw cap 11 even if it starts to get dry.

When the screw caps 11 are screwed on the external thread sections 7, the applicator tips bear against the inner surface of a cover 17 (specified below) and are prompted by the screwing motion to perform a rotary motion relative to the cover 17. At the same time, the applicators 10 are elastically deformed, the cosmetic being applied to them uniformly. In this case, the applicator pipes 8 are forced into the interior of the basic body 2 against the action of the helical spring 3, the latter providing for the necessary pressure of the applicator 10 acting against the inner surface of the cover 17 which itself is pressed against the surface 16 of the cosmetic.

Figure 2:
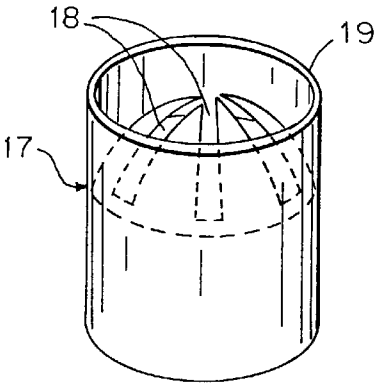
FIG. 2 is an illustration, on an enlarged scale, of the cover according to the invention.

The cover 17 seen on an enlarged scale in FIG. 2 comprises a plurality of slits 18 which extend from the center or tip radially outward and through which the cosmetic can get from the surface 16 to the applicator 10. An encircling lip 19 joined on provides for the cosmetic to be scraped off the innerwall of the reservoir as the encircling lip 19 engages the innerwall. The ring 13, which is open inside, can be screwed in to cap 11 so as to serve as an axial stop limiting the displacement of the cover 17. Threads 7*a* of ring 13 correspond to internal threads 12 in cap 11 as shown in the drawings.

As a result of the cover 17 provided according to the invention, it is possible to use even a very soft substance.

What is claimed is:

1. A cosmetic pencil comprising at least one applicator to which a detachable reservoir for a cosmetic substance is engaged, the applicator and the reservoir being spring-loaded and rotatable relative to each other, wherein, between a surface (16) of the cosmetic substance and the applicator (10), the reservoir has an axially displaceable cover (17) provided with apertures engaged to the surface 16 and the applicator, wherein the shape of the cover (17) corresponds to the shape of the applicator (10), and wherein the cover (17) has lateral lips joined thereon which slidably engage an inner wall of the reservoir.

2. A cosmetic pencil according to claim 1, wherein the apertures are slits.

3. A cosmetic pencil according to claim 2 wherein the slits extend from a center radially outward.

4. A cosmetic pencil according to claim 1, wherein the cover (17) is netted.

5. A cosmetic pencil according to claim 1, wherein a ring (13) having an internal thread (12) is fixed in the vicinity of an outer edge of the reservoir to limit axial displacement of the cover 17 within the detachable reservoir.

6. A cosmetic pencil, comprising at least one applicator, to which a detachable reservoir for a cosmetic substance is engaged, the applicator and the reservoir being rotatable relative to each other, wherein, between the surface (16) of the cosmetic substance and the applicator (10), the reservoir has an axially displaceable cover (17) provided with apertures, wherein the shape of the cover (17) corresponds to the shape of the applicator (10) and wherein the cover (17) has lateral lips (19) joined thereon which slidably engage an inner wall of the reservoir.

* * * * *